US005816794A

United States Patent [19]

Tsai

[11] Patent Number: 5,816,794

[45] Date of Patent: Oct. 6, 1998

[54] JET TYPE GAS BURNING DEVICE

[76] Inventor: Chin-Lin Tsai, 3F, No. 94, Sec. 4, Chung Hsin Rd., San Chung City, Taipei Hsien, Taiwan

[21] Appl. No.: 821,319

[22] Filed: Mar. 20, 1997

[51] Int. Cl.[6] ..... F23D 14/28

[52] U.S. Cl. ..... 431/344; 431/255

[58] Field of Search ..... 431/344, 345, 431/262, 233, 242, 244, 247, 255, 285

[56] References Cited

U.S. PATENT DOCUMENTS

| | | | |
|---|---|---|---|
| 4,720,259 | 1/1988 | Day | 431/344 |
| 4,938,686 | 7/1990 | Yoshinaga | 431/344 |
| 5,466,149 | 11/1995 | Tsai | 431/344 |
| 5,564,919 | 10/1996 | Tsai | 431/344 |

*Primary Examiner*—James C. Yeung
*Attorney, Agent, or Firm*—Bacon & Thomas

[57] ABSTRACT

An improved jet type burning device including a burner body, a control device, an ejection device, a fuel gas reverse flow device, and a support device. The burner body is connected to the support device below for connection with a gas container. One side is connected to the control device for controlling fuel gas connection. A fuel nozzle is connected to a relay tube with threads. The relay tube is passed through a stepped hole of the reverse flow device to engage a stepped groove of the burner body. The ejection device and the reverse flow device are secured in a stepped seat. A first hole is formed at the rear end of the relay tube to communicate with an oblique groove. A second hole is disposed at the other side for connection with the ejection device. The first and second holes are respectively provided with a first through hole and a second through hole for matching a first side hole and a second side hole of the reverse flow device. The side holes are respectively connected to an intake tube and a discharge tube of a conventional reverse flow tube so that fuel gas may pass through the support device and is completely vaporized in the gas path before being ejected.

16 Claims, 5 Drawing Sheets

JET TYPE GAS BURNING DEVICE

BACKGROUND OF THE INVENTION (a) Field of the Invention

The present invention relates generally to a gas burner, and more particularly to an improved jet type gas burning device.

(b) Description of the Prior Art

Heating or burning devices utilizing containerized gas are available in two main types. The first type is disclosed in the inventor's U.S. Pat. No. 5,446,149, in which a gas valve at the top of a gas container is connected to a fill nozzle at the bottom of a heating torch so that containerized gas in the container may fill the gas tank to provide the gas release means and flame generating means with gas. Another type is described in U.S. Pat. No. 4,804,324 to Prince Industrial Development Co., Ltd. A support device is disposed at the lower end for pivotal connection with a gas container so that the liquefied gas in the container may become vaporized to supply a burning means with the necessary gas for welding, soldering or other hot gas operations.

In gas burning devices with gas tanks, generally the nozzle of the gas container is coupled to a gas valve of the gas tank so that liquefied gas in the container may enter the gas tank. During the process of filling, the pressure of gas or liquefied gas entering the gas tank will decrease drastically. And when it has flowed through the gas path to the flame nozzle for ejection, the flame thus ignited will be relatively small, which is only suitable for small-scale heating, welding or drying operations. For conventional gas containers, as the filling of liquefied gas is under high pressure, when it is directly coupled to the gas pistol, the fuel gas ejected under high pressure will achieve a greater flame for relatively large-scale burning jobs. However, during welding operations, the gas containers are often inverted. As a result, the liquefied gas released at high pressure cannot be completely vaporized before combustion, which affects combustion efficiency and is dangerous.

In addition, at low temperature working environments, incomplete vaporization may result when liquefied gas is converted into gaseous fuel. Apart from the disadvantage that the burning device cannot be ignited easily, it is also a waste of fuel.

SUMMARY OF THE INVENTION

Accordingly, a primary object of the present invention is to provide an improved jet type gas burning device to eliminate the drawbacks with the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
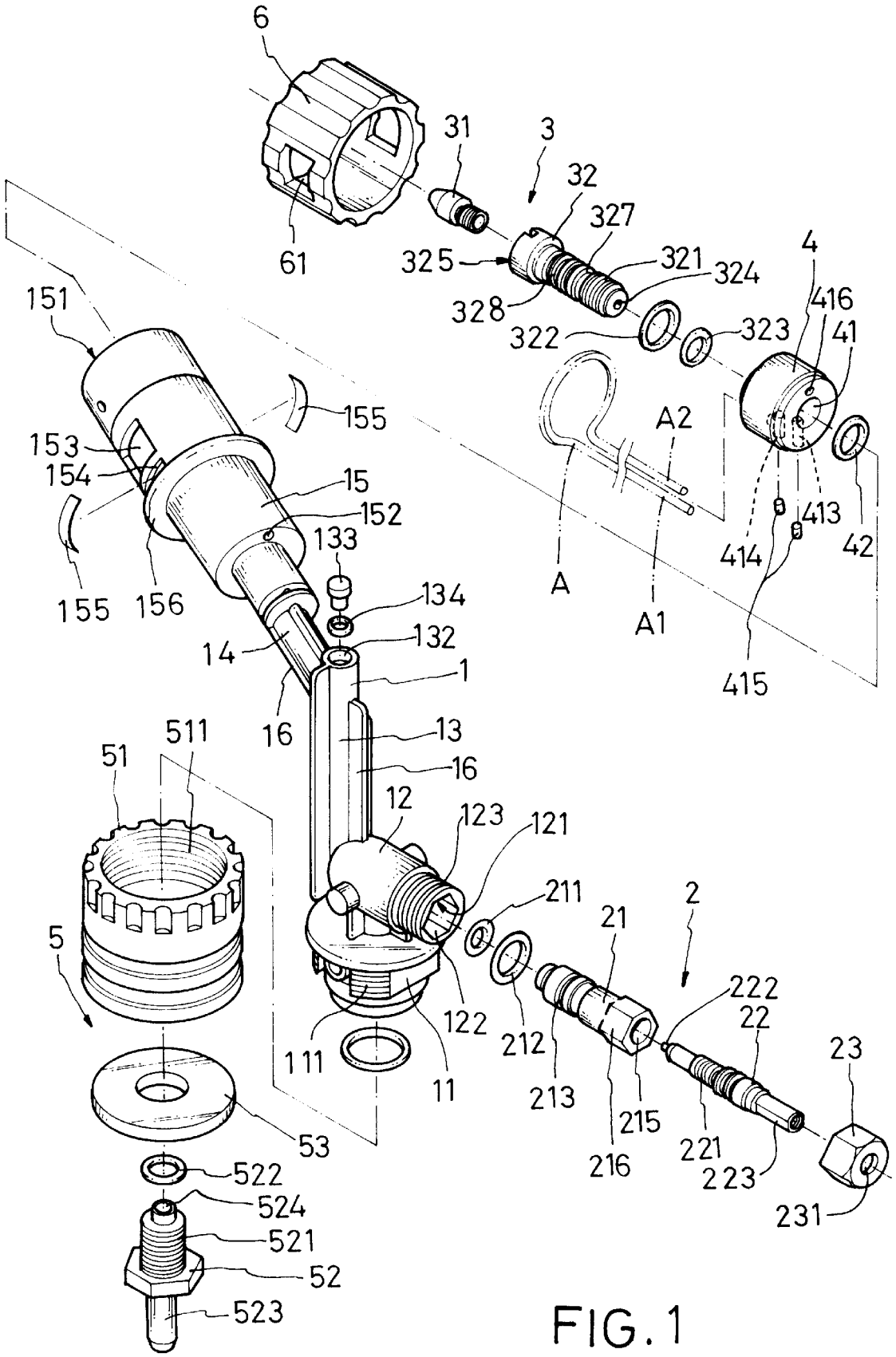
FIG. 1 is a schematic elevational exploded view of a first preferred embodiment of the present invention.

With reference to the drawings, basically, the gas burning device of the present invention comprises a burner body 1, a control device 2, an ejection device 3, a fuel gas reverse flow device 4 and a support device 5.

Figure 2:
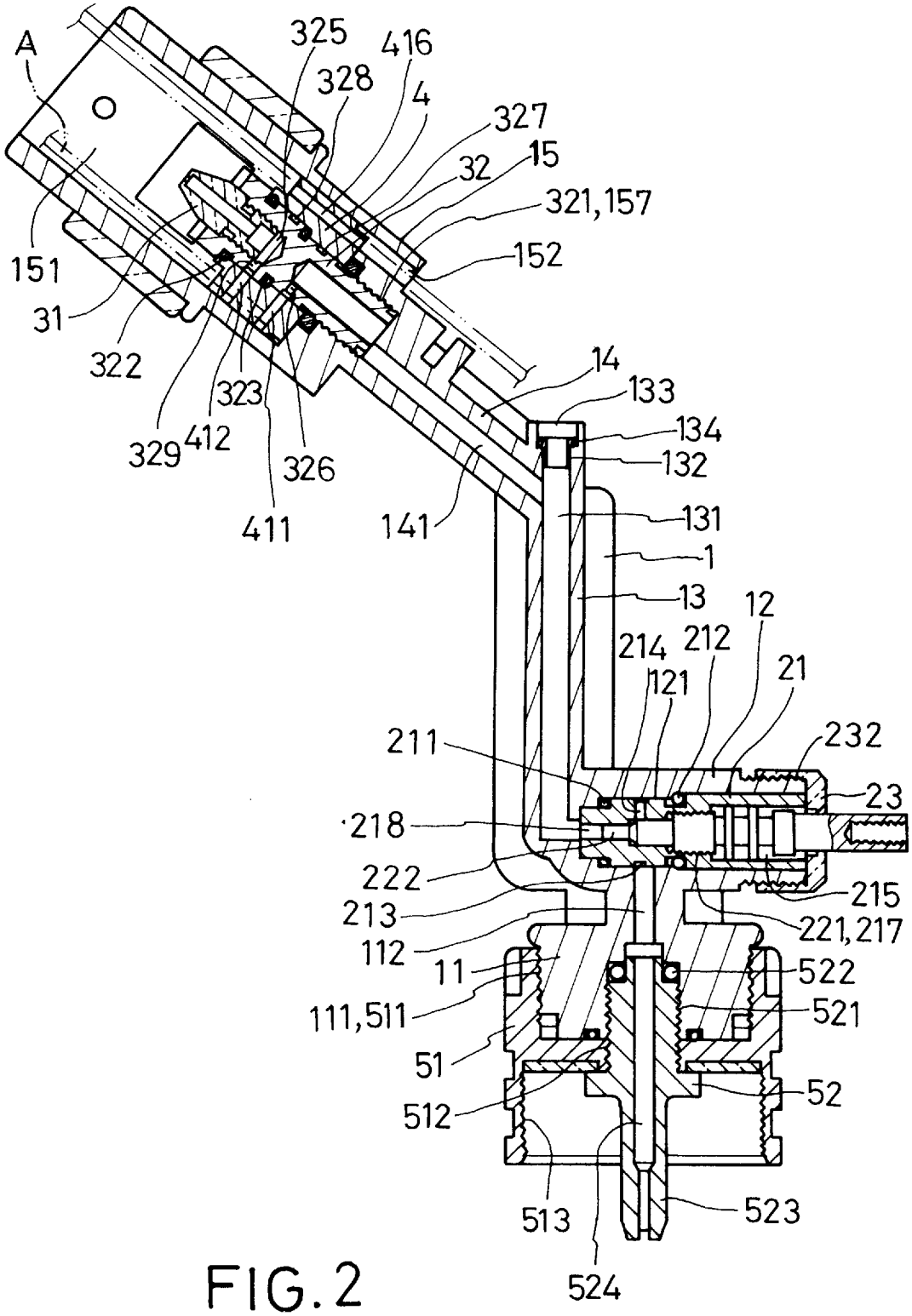
FIG. 2 is a schematic sectional view of the present invention after assembly.
Figure 4:
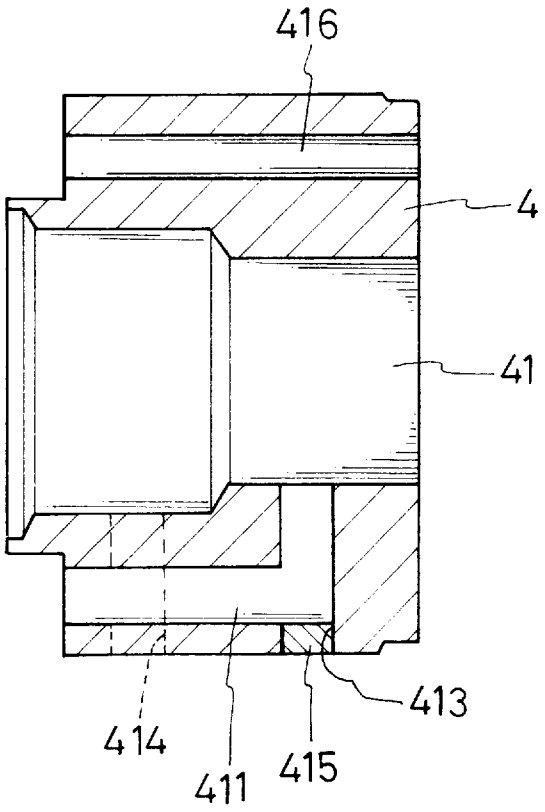
FIG. 4 is a sectional view taken along line A—A of FIG. 3.
Figure 3:
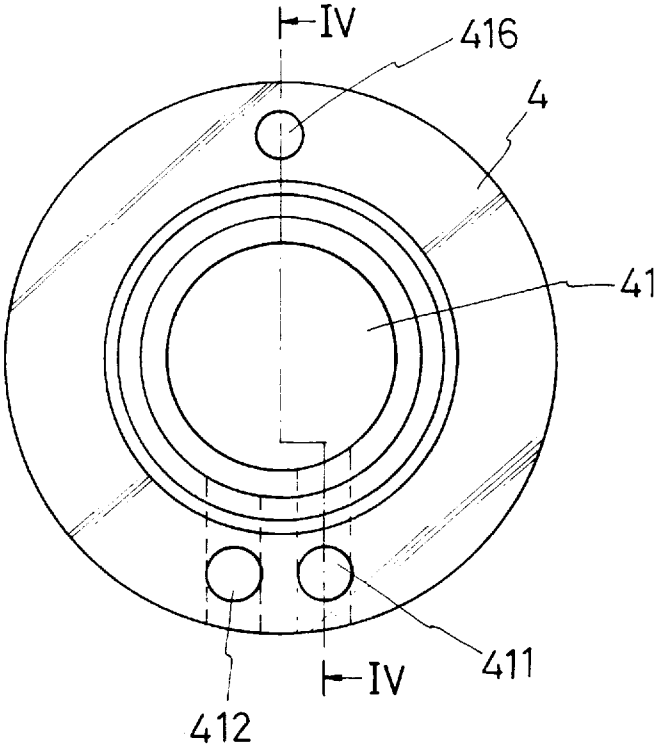
FIG. 3 is a left side view of a reverse flow device of the present invention.

Referring to FIGS. 1 and 2, the burner body 1 is an integral structure having a connecting seat 11 with a plurality of outer threads 111 at its periphery at a lower portion thereof for coupling to the support device 5. The connecting seat 11 is internally provided with a longitudinal channel 112 for entrance of fuel gas into the burner body 1. An upper portion of the connecting seat 11 is provided with a horizontally disposed extension seat 12 with a groove 121 therein communicating with the channel 112 for entrance of fuel gas. The groove 121 is provided for connecting to the control device 2 for controlling fuel gas connection. Additionally, a vertical rod 13 extends upwardly from one side of the extension seat 12. The vertical rod 13 has therein a groove 131 communicating with the groove 121 of the extension seat 12. An upper end of the vertical rod 13 is a rod hole 132 sealed by a cock 133 after being fitted with an O-ring 134 so as to prevent leakage of fuel gas.

In addition, an oblique rod 14 extends obliquely from one side of the vertical rod 13. The oblique rod 13 has therein an oblique groove 141 communicating with the groove 131 of the vertical rod 13 for passage of fuel gas therethrough. A stepped seat 15 of a larger size extends from a front end of the oblique rod 14. The stepped seat 15 chiefly encloses the ejection device 3 and the fuel gas reverse flow device 4 and is connected thereto. It is internally provided with a one-tier stepped groove 151. One end of the stepped seat 15 is provided with a through hole 152 for passage of the electric wire (shown by imaginary lines in FIG. 2) of a conventional piezo electric device, the wire passing through the stepped groove 151 to be located near a conventional flame nozzle to ignite the mixture of fuel gas and air ejected by the flame nozzle.

The control device 2 essentially comprises a sleeve 21 inserted into the groove 121 of the extension seat 12 with one end portion and a middle section respectively fitted with O-rings 211, 212 to prevent leakage of fuel gas. Near the front end of the sleeve 21 is provided an annular neck 213 having a hole 214 thereon (see FIG. 2) communicating with a through hole 215 at the center of the sleeve 21, so that fuel gas may pass from the channel 112 through the neck 213 and the hole 214 into the through hole 215.

In order that the groove 121 and the sleeve 21 may be firmly coupled, a polygonal hole 122 is provided at an open end of the groove 121 and a polygonal nut 216 is provided at the rear end of the sleeve 21, so that when they insertably engage each other, due to the urging action of the polygonal hole 122 and the polygonal nut 216, turning movement of the groove 121 and the sleeve 21 may be prevented. Preferably, the polygonal hole 122 and the polygonal nut 216 are hexagonal.

In order to achieve control of fuel gas connection, the through hole 215 is connected to an adjustment screw rod 22 which has a threaded section 221 in the middle for matching a threaded section 217 formed within the through hole 215, so that the entire adjustment screw rod 22 may displace transversely within the sleeve 21. During the process of forward displacement, a projection 22 of the adjustment screw rod 22 may close a neck hole 218 at a front end of the through hole 215 to cut off the supply of fuel gas. When the adjustment screw rod 22 retreats, the projection 222 thereof will depart from the neck hole 218 to define a clearance therebetween to allow passage of fuel gas.

In order that the adjustment screw rod 22 may be firmly secured to prevent possible separation from the sleeve 21 due to excessive turning, a post 223 at a rear end of the adjustment screw rod 22 is passed through a nut hole 231 at the center of a nut 23. The inner threads 232 lock with the outer threads 123 of the extension seat 12 to prevent disengagement of the adjustment screw rod 22. In addition, that part of the post 223 extending from the nut 23 is connected to a rotary knob (not shown) so that when the knob is turned, the adjustment screw rod 22 may be synchronously brought to displace transversely within the sleeve 21 to control fuel gas supply.

The ejection device 3 essentially comprises a fuel nozzle 31 and a relay tube 32 locked therewith. The relay tube 32 has a plurality of outer threads 321 and is passed through the fuel gas reverse flow device 4 to further engage the threads 157 at the rear portion of the stepped groove 151, so that the ejection device 3 and the fuel gas reverse flow device 4 may be fixedly disposed in the stepped seat 15. In order to prevent leakage of fuel gas, the outer threads 321 of the relay tube 32 are fitted with two O-rings 322 and 323, and a rear side of the relay tube 32 is provided with a first hole 324 which is not through and communicates with the oblique groove 141. The other side thereof is provided with a second hole 325 with a plurality of threads, which communicates with the fuel nozzle 31. A front end of the first hole 324 is longitudinally provided with a first through hole 326 (see FIG. 2) which communicates with a first neck 217 of an annular ring so that fuel gas may pass from here into the fuel gas reverse flow device 4.

Referring to FIGS. 1–4, the fuel gas reverse flow device 4 is centrally provided with a stepped hole 41 for passage of the relay tube 32 in a tightly joined relationship. A rear end of thereof is provided with a leak-proof ring 42 for fitting onto the relay tube 32 after the latter has passed through the stepped hole 41. The leak-proof ring 42 is disposed intermediate the threads 157 of the stepped groove 151 and the reverse flow device 4 to prevent possible leakage of fuel gas. In order that fuel gas may be connected and communicate with a conventional reverse flow tube A (shown by imaginary lines in FIG. 2), a first side hole 411 may be formed at a position corresponding to the first through hole 326 to allow connection with an intake tube A1 of the reverse flow tube A so that fuel gas may pass through the path of the reverse flow tube A via a discharge tube A2 into a second side hole 412 formed near the first side hole 411. At this point, fuel gas passes through a second neck 328 between the O-rings 322 and 323 of the relay tube 32 via the second through hole 329 into the second hole 325 at the front end of the relay tube and finally out through the fuel nozzle 31.

In order to simplify the processing steps for fuel gas reverse flow device 4, the bottom sides of the first side hole 411 and the second side hole 412 are respectively, longitudinally provided with a first bottom hole 413 and a second bottom hole 414 to allow communication with an outer wall of the reverse flow device 4. In practice, longitudinal holes are drilled in advance before drilling the transverse holes from the front so that the longitudinal holes and the transverse holes communicate with each other. A stopper 415 is then used to seal the first bottom hole 413 and the second bottom hole 414 to prevent leakage of fuel gas.

The reverse flow device 4 is further transversely provided with a third side hole 416 for matching the through hole 152 of the stepped seat 15 to allow passage of the electric wire of the piezo electric device.

The support device 5 is pivotally connected to the connecting seat 11 at its upper portion. Its lower portion is connected to a gas container. By means of the support device 5, liquid or gaseous fuel may be sent into the channel 112 of the burner body 1 to flow along the above-described path. The sufficiently vaporized fuel gas is then ejected from the fuel nozzle 31.

Referring to FIGS. 1 and 2, the support device 5 essentially comprises a cylindrical outer annular button 51 having a plurality of inner threads 511 for engaging the outer threads 111, a cross-shaped urge pin 52 having a threaded section 521 at an upper portion thereof and a nozzle 523 at a lower portion thereof. An O-ring 522 is fitted onto the threaded section 521 before the urge pin 52 is passed through a packing ring 53 and a central hollow 512 of the annular button 51 to be connected to the channel 112. The nozzle 523 is caused to urge against a nozzle of a gas container of the US specification so that fuel gas may enter via a feed slot 524 in the center of the nozzle 523 into the burner body 1. A plurality of inner threads 513 formed at a lower portion of the annular button 51 lock with a locking portion at an outer rim of the nozzle of the gas container so that they may be firmly locked together.

In order that air may enter the stepped groove 151 to mix with the fuel gas, one or more air vents 153 are formed in the stepped groove 151 corresponding to the position of the fuel nozzle 31. On both sides of the rear side of the air vents 153 are respectively provided a retain slot 154 for insertion of a curved elastic plate 155. An annular flange 156 is disposed behind the retain slot 154 to serve as a stop when an air adjustment knob 6 is coupled to the stepped seat 15. The two elastic plates 155 extend outwardly to contact the inner wall of the adjustment knob 6 so as to enhance friction and positioning effects of the adjustment knob 6. Additionally, the adjustment knob 6 is also provided with a plurality of slots 51 corresponding to the air vents 153 so that turning of the adjustment knob 6 may control the extent the holes 61 shield the air vents 153 so as to adjust the amount of induced air.

Figure 5:
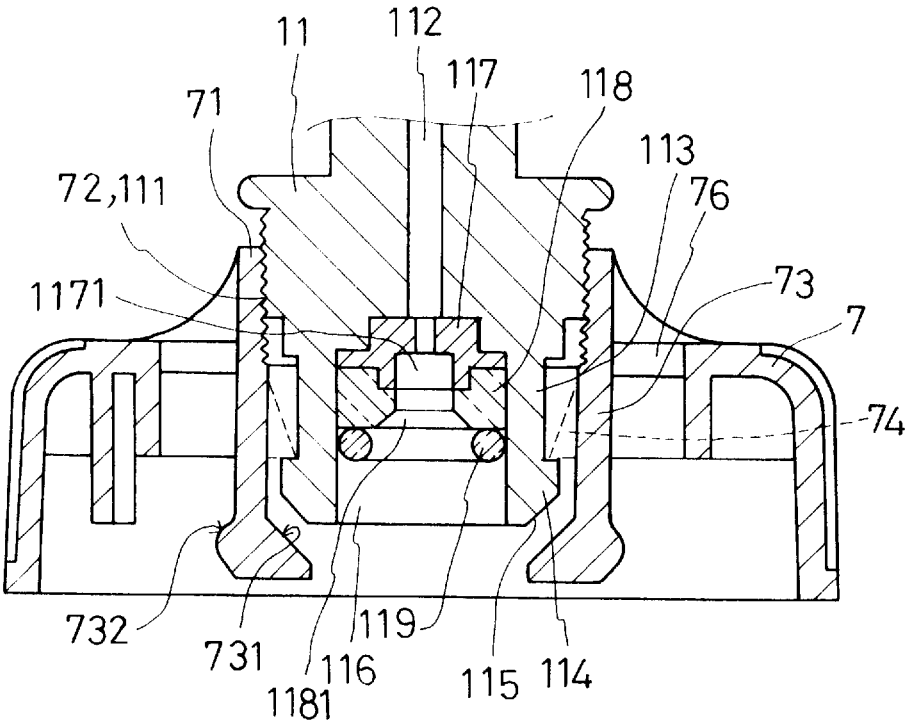
FIG. 5 is a schematic view of a second preferred embodiment of the present invention.
Figure 6:
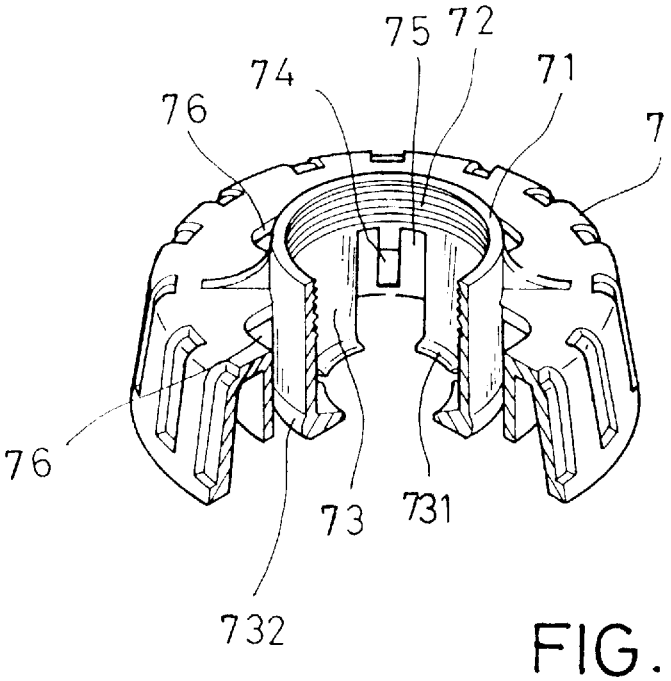
FIG. 6 is a schematic elevational view of the present invention in part.

Referring to FIGS. 5 and 6 which show a second preferred embodiment of the support device 5, a neck 113 extends from a lower portion of the outer threads 111 of the connecting seat 11, and the bottom side of the neck 113 extends integrally outwardly to form a flange 114. The corners at the bottom portion of the flange 114 form an annular slanting portion 115. In addition, in order that the present invention may be used in conjunction with gas containers of the Japanese specification, a protrudent connecting hole 116 of a larger diameter is provided at the bottom side of the channel 112 for receiving a rubber pad 117 formed of high molecular material and having a protrudent hole 1171. The rubber pad 117 has a metallic tightening ring 118 inserted therebelow to urge against the rubber pad 117. The tightening ring 118 has a flared hole 1181 communicating with the protrudent hole 1171 so that when it is connected to the nozzle of the gas container the fuel gas may smoothly enter the channel 112. Furthermore, in order to prevent leakage of fuel gas, the connecting hole 116 below the tightening ring 118 is fitted with an O-ring 119 therein.

The above-mentioned second embodiment of the support device 5 essentially comprises an injection molded securing cover 7 having a post 71 projecting from the center thereof for matching the outer threads 111. The upper inner wall thereof is provided with a threaded section 72 for engaging the outer threads 111. A plurality of projections 73 and hooks 74 extend longitudinally below the threaded section 72. The projections 73 and hooks 74 are alternately arranged with gaps 75 defined therebetween to provide a suitable resilience and stretching force. At the same time, in order to observe coupling of the projections 73 with the projecting rim portion of the gas container of the Japanese specification and to provide stretching strength, a slot 76 is provided at the joint between the projection 73 and the securing cover 7. Each projection 73 is further provided with a slanting portion 731 at a bottom end for matching the annular slanting portion 115. On the opposite side of the slanting portion 731 is formed a swollen portion 732. When each slanting portion 731 is caused to displace downwardly due to the lowering of the burner body 1 upon turning, it may urge against the annular slanting portion 115. And when it stretches outwardly, the swollen portion 732 will also be caused to displace outwardly to fasten the projected rim portion of the gas container so that the securing cover may couple to the gas container. And when the hooks 74 urge against the flange 114 of the neck 113, the latter will be checked. At this point, the securing cover 7 cannot be rotated any more, and the projections 73 thus lose support of the slanting portions 115 and reset. A new gas container may then be replaced.

Figure 7:
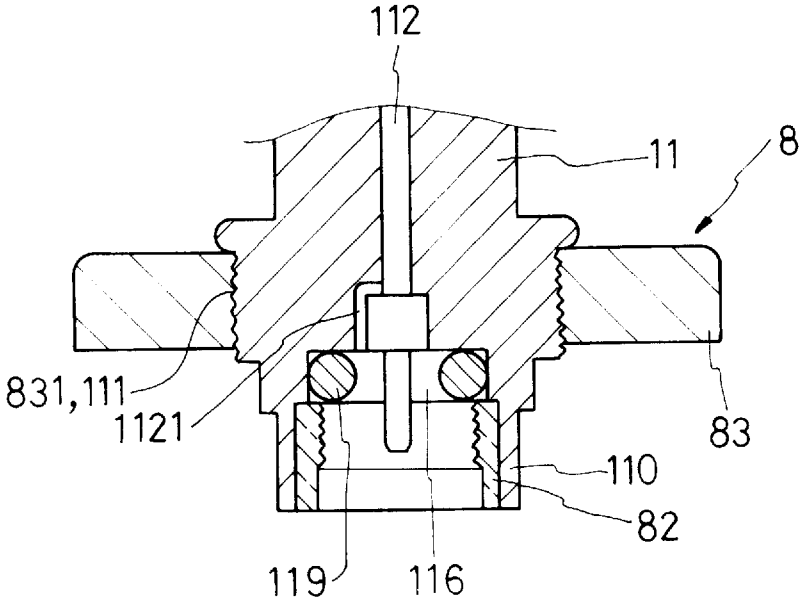
FIG. 7 is a schematic view of a third preferred embodiment of the present invention.

Referring to FIG. 7, which shows a third preferred embodiment of support device of the present invention, a pin 81 of a support device 8 is inserted into the connecting hole 116 at the lower portion of the channel 112 of the connecting seat 11. And a side hole 1121 is disposed at a lateral side of the connecting hole 116 to communicate with the channel 112 for passage of fuel gas into the burner body 1. In order to prevent leakage, an O-ring 119 is inserted into the connecting hole at the side of the pin 81. And in order that the connecting seat 11 may couple to a gas container of the European specification, a neck ring 110 which appears round on the outside but is polygonal internally is provided to extend longitudinally downward from the outer threads 111. A polygonal metal ring 82 having inner threads is inserted into the neck ring 110 to permit locking with a coupling portion of the gas container. A securing ring 83 having a central screw hole 831 is then caused to displace downwardly along the outer threads 111 to urge against the gas container to achieve positioning.

In addition, in order to enhance the strength of the vertical rod 13, the oblique rod 14 and the channel 112 between the extension seat 12 and the connecting seat 11, the outer side may be longitudinally provided with a plurality of reinforcing ribs 16 to prevent possible bending or cracking due to external impacts.

The advantages achievable by the present invention are enumerated as follows: 1. The burner device of the present invention is simple in construction and quick to assemble. As the burner body is integrally molded, it can be easily connected to its components such as the control device, the ejection device, the fuel gas reverse flow device and the support device. 2. The present invention may be connected to conventional burner devices. The present invention may be further connected to a flame ejection device, an outer tube, and a piezo electric device, and may be wrapped in a shell to form a complete gas burning device. 3. The fuel gas reverse flow device may further be connected to different types of reverse flow tubes to enhance vaporization of fuel gas. 4. The control device and the extension seat are secured in position by polygonal structures so as to reduce assembly steps and achieve good positioning effects. 5. The fuel ejection device is directly passed through the fuel gas reverse flow device and locked within the burner body. Therefore, assembly of the same may be done by a single step of locking. 6. By means of different embodiments of the support device, the present invention may be adopted for use with gas containers of the US, Japanese and European specifications.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved jet gas burning device, comprising: a burner body, said burner body being an integral structure having a connecting seat at a lower portion, and internally provided with a channel communicating with a groove of an extension seat located there above, a vertical rod extending from one side of said extension seat and having a groove communicating with said groove of said extension seat, an oblique rod extending upwardly from a top end of said vertical rod and having an oblique groove communicating with said groove of said vertical rod, and a stepped seat extending from a front end of said oblique rod and internally having a stepped groove;

a control device located in said groove of said extension seat and having an adjustment screw rod to control a supply of fuel gas and passage of fuel gas between said channel and said groove of said vertical rod;

an ejection device and a fuel gas reverse flow device mounted in said stepped groove by, a relay tube of said ejection device passing through a stepped hole in said reverse flow device and threaded in to said stepped groove, a first hole being disposed at a rear side of said relay tube in communication with said oblique groove, a fuel nozzle connected to a second hole in said relay tube, said first hole not communicating with said second hole, a first through hole formed at a front end of said first hole communicating with a first side hole of said reverse flow device, a second through hole being formed at a rear end of said second hole for communicating with a second side hole of said reverse flow device; reverse flow device having an intake tube respectively connected to said first side hole; and a support device having an upper portion connected to said connecting seat and a lower portion configured to be connected to a gas container, so that gas in the gas container may enter said support device, and completely vaporized gas is ejected through said fuel nozzle.

2. The improved jet gas burning device as claimed in claim 1, wherein said vertical rod is provided with a hole at, a top end which is sealed by a cock fitted with an O-ring so as to prevent gas leakage.

3. The improved jet gas burning device as claimed in claim 1, wherein said control device comprises a sleeve inserted into said groove of said extension seat, said sleeve having an annular neck adjacent to a front end thereof and a hole disposed between said channel and a through hole of said sleeve, said through hole connected to a movable adjustment screw rod displaceable within said through hole, said screw rod having a projection engagable with a neck hole at a front end of said through hole so as to control supply of fuel gas, a post of said screw rod passing through a central nut hole of a nut, said nut engaging said extension seat to prevent separation of said sleeve and said extension seat.

4. The improved jet gas burning device as claimed in claim 3, wherein an open end of said groove of said extension seat and a corresponding end of said sleeve have engaging polygonal cross-sectional configurations.

5. The improved jet gas burning device as claimed in claim 1, wherein said first through hole is located within a first neck of said relay tube in communication with said first side hole of said reverse flow device, and said second through hole is located in a second neck of said relay tube in communication with said second side hole of said reverse flow device.

6. The improved jet gas burning device as claimed in claim 1, wherein respective bottom sides of said first side hole and said second side hole communicate with a first bottom hole and a second bottom hole, respectively, each bottom hole sealed by a stopper.

7. The improved jet gas burning device as claimed in claim 1, wherein said stepped seat has at least one air vent in an outer wall thereof adjacent to said fuel nozzle, and an annular projecting flange disposed to the rear thereof; an air adjustment knob movably mounted on said stepped seat, said adjustment knob having at least one knob hole whereby turning said adjustment knob controls the amount of induced air into the stepped seat.

8. The improved jet gas burning device as claimed in claim 7, further comprising at least one retain slot disposed between said at least one air vent and said annular projecting flange' and a curved elastic plate in said at least one retain slot and connected to the inner wall of said air adjustment knob to enhance friction between the air adjustment knob and the stepped seat.

9. The improved jet gas burning device as claimed in claim 1, wherein said stepped seat has a through hole formed at one side thereof, and said fuel gas reverse flow device has a third side hole communicating with said through hole for passage of an electric wire of a piezo electric device.

10. The improved jet gas burning device as claimed in claim 1, wherein said support device comprises an outer annular button connected to said connecting seat, a cross-shaped urge pin having a central feed groove passing through a packing ring and a central hollow of said annular button and connected to said connecting seat such that said central feed groove communicates with said channel; and a second nozzle at a lower portion of said urge pin coupled to a gas container.

11. The improved jet gas burning device as claimed in claim 1, further comprising a neck extending from a lower portion of said connecting seat, a bottom portion of said neck extending outwardly to form a flange, a bottom corner of said flange forming an annular slanting portion, and a connecting hole formed at a bottom portion of said channel and receiving therein a rubber pad having a hole and a tightening ring configured for connecting to a nozzle of a gas container; said support device having a securing cover with a post extending from a center thereof, said post having an inner threaded section engaging said connecting seat, a plurality of projections extending longitudinally from below said inner threaded section with a plurality of gaps disposed between adjacent projections, each projection having a slanting portion communicating with said annular slanting portion; an enlarged portion provided opposite to said slanting portion such that when said threads of said connecting seat engage said inner threaded section to cause said annular slanting portion to displace downwardly so as to contact said slanting portion of said securing cover, said projections are caused to stretch outwardly while said swollen portions engage a projecting rim portion of a gas container and a nozzle of the gas container extends into said rubber pad and the hole of said tightening ring to be pressed thereby so as to be firmly locked therein.

12. The improved jet gas burning device as claimed in claim 11, further comprising hooks disposed between said gaps so that when said bottom flange of said neck engages said hooks, said securing cover is prevented from displacing downwardly.

13. The improved jet gas burning device as claimed in claim 1, wherein said connecting hole at the lower portion of said channel of said connecting seat engages a pin of said support device, one side of said pin having a side hole communicating with said channel, and a neck ring having a circular outer cross-sectional configuration and a polygonal inner cross-sectional configuration extends longitudinally from said connecting seat, said neck ring having a polygonal ring with inner threads inserted therein connecting a coupling portion of a gas container so that a nozzle of the gas container is pressed by said pin to allow the fuel gas to flow through said side hole into said channel.

14. The improved jet gas burning device as claimed in claim 13, wherein said connecting seat is coupled with a securing ring having a central screw hole so that the securing ring may displace downwardly along said connecting seat to engage the gas container.

15. The improved jet gas burning device as claimed in claim 4, wherein said polygonal cross-sectional configuration are hexagonal.

16. The improved jet gas burning device as claimed in claim 13, wherein said neck ring has a hexagonal inner hole and said polygonal ring is hexagonal in configuration.

* * * * *